US007305784B2

(12) United States Patent
Black

(10) Patent No.: US 7,305,784 B2
(45) Date of Patent: Dec. 11, 2007

(54) ATTACHABLE ADAPTER FOR MOUNTING INDEX TABS

(75) Inventor: Steven Charles Black, Hastings, MN (US)

(73) Assignee: Smead Manufacturing Company, Hastings, MN (US)

( * ) Notice: Subject to any disclaimer, the term of this patent is extended or adjusted under 35 U.S.C. 154(b) by 0 days.

(21) Appl. No.: 11/130,516

(22) Filed: May 17, 2005

(65) Prior Publication Data

US 2005/0257408 A1 Nov. 24, 2005

Related U.S. Application Data

(60) Provisional application No. 60/573,788, filed on May 24, 2004.

(51) Int. Cl.
*B42F 21/00* (2006.01)
*B42F 21/06* (2006.01)
*G09F 23/10* (2006.01)

(52) U.S. Cl. ..... 40/641; 40/360; 40/359; 402/79; 283/36

(58) Field of Classification Search ..... 40/359, 40/360, 641; 402/79; 283/36–38
See application file for complete search history.

(56) References Cited

U.S. PATENT DOCUMENTS 4,053,057 A 10/1977 Snowden
5,503,487 A * 4/1996 Ong ..... 402/79
5,683,113 A 11/1997 Petrucci
5,813,734 A * 9/1998 Ong ..... 312/184
5,996,881 A 12/1999 Smith
6,332,285 B1 12/2001 Aaldenberg et al.

* cited by examiner

*Primary Examiner*—Cassandra Davis
(74) *Attorney, Agent, or Firm*—Altera Law Group, LLC

(57) ABSTRACT

An index tab adapter, suitable for retrofitting an existing file folder for use with a particular index tab style. The adapter has adhesive portions, located on either side of a non-adhesive portion. The non-adhesive portion is slotted and is spaced apart from the file folder. The slots are shaped to engage a particular style of index tab, so that when a given index tab is inserted into the slots in the adapter, the given index tab becomes attached to the file folder, and the file folder may be identified by the given index tab as if it were originally configured to accept the style of the given index tab. Put another way, an index tab removably engages slots in the adapter, rather than slots in the file folder itself.

8 Claims, 4 Drawing Sheets

ATTACHABLE ADAPTER FOR MOUNTING INDEX TABS

CROSS-REFERENCE TO RELATED APPLICATIONS

The present application claims the benefit of U.S. Provisional Application Ser. No. 60/573,788 filed on 24 May 2004, the complete subject matter of each of which is hereby incorporated herein by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention is directed to an attachable adapter for mounting index tabs on a file folder.

2. Description of the Related Art

File folders in an office setting may be configured for a particular type of index tabs. For example, a particular office may use hanging folders that are designed for slot-in tabs. On occasion, the office may acquire a series of files that use a different index tab, say clip-on tabs, rather than slot-in tabs. For instance, an office may acquire a group of file folders from a consolidation of two offices, and the newly acquired folders may use the wrong type of tabs, or may not use index tabs at all. In general, it would be highly desirable to retrofit the newly acquired folders with the proper tabs, rather than replace all the file folders themselves. There exists a need for an inexpensive adapter that may be attached to an existing file folder, which enables the use of a predetermined index tab configuration.

A prior art folder is disclosed in U.S. Pat. No. 4,053,057, in which a suspended filing folder has the top edge of one side slotted and folded around one suspension bar to accept slot-in tabs, and the other suspension bar is formed into a laminar structure with the top edge of the other side, and is embossed with a row of crimps to retain clip-in tabs. Although this particular file folder may readily accept both slot-in tabs and clip-on tabs, it does not address the problem of conversion from one type of tab to another, without replacement of the folder itself.

A prior art edge mounted index tab is disclosed in U.S. Pat. No. 5,683,113. The tab has a rectangular portion that provides a space for the placement of labels or other indicia. Extending from adjacent corners along the longitudinal margin of the rectangular portion are upper and lower feet. The lower foot is semi-elliptical, having a linear edge parallel to the longitudinal margin of the rectangular portion. The upper foot extends outward from the longitudinal margin of the rectangular portion, curving slightly downward relative thereto. A slotted offset is disposed between the upper foot and the rectangular portion. Upper and lower feet are inserted into corresponding holes along the folded edge of an item having a folded edge. A slight downward pull on the rectangular portion locks the edge of the upper hole into the slotted offset, and a pull in the opposite direction allows removal of the index tab. A drawback to the tab disclosed in U.S. Pat. No. 5,683,113 is that it requires suitable slots along the edge of the folder or file; this tab does not address the problem of retrofitting an existing file or folder.

A convertible folder is disclosed in U.S. Pat. No. 5,996,881. The folder is formed from a single blank and includes a pair of folder panels hingedly connected along a fold line. A pocket-defining panel is folded against one of the folder panels and cooperates therewith to form a pocket for containing documents. A small tab-supporting panel is secured to and folded against the pocket-defining panel in the preferred embodiment. An identifying tab is movably secured to the tab-defining panel and is moveable between a display position and an out-of-the-way position to allow delivery/presentation folder to be readily converted to a conventional file folder. However, the moveable identifying tab of U.S. Pat. No. 5,996,881 does not enable a folder with one type of tab, say a slot-in tab, to be used with another type of tab, say a clip-in tab, without complete replacement of the folder.

A repositionable indexing tab is disclosed in U.S. Pat. No. 6,332,285. The tab has two downwardly extending walls, designed to fit over the edge of a file or folder and create an interference fit that secures it in place. The tab is made of a flexible polymeric material so that it may be mounted, repositioned or removed easily. Removal of the tab from a wall edge causes the walls to flex apart and thereby eliminate or minimize the interference fit between the tab lower walls and the article on which the tab is mounted. Removal of the tab is therefore a smooth and simple operation that minimizes breakage of the tab or damage to the folder, organizer or storage medium. Although this indexing tab is easily attachable to the edge of any type of folder, regardless of the type of index tabs for which the folder is designed, it does not address the issue of conversion or retrofitting of a folder from one particular type of index tabs to another.

The prior art devices described above all fail to address the conversion or retrofitting of a folder with one type of tab, say a slot-in tab, so that it may be used with another type of tab, say a clip-in tab, without complete replacement of the folder. Clearly, there exists a need for an inexpensive index tab adapter that may be easily attached to an existing folder, which may allow the folder to use index tabs of a type for which it was not originally designed.

DETAILED DESCRIPTION OF THE INVENTION

Figure 1:
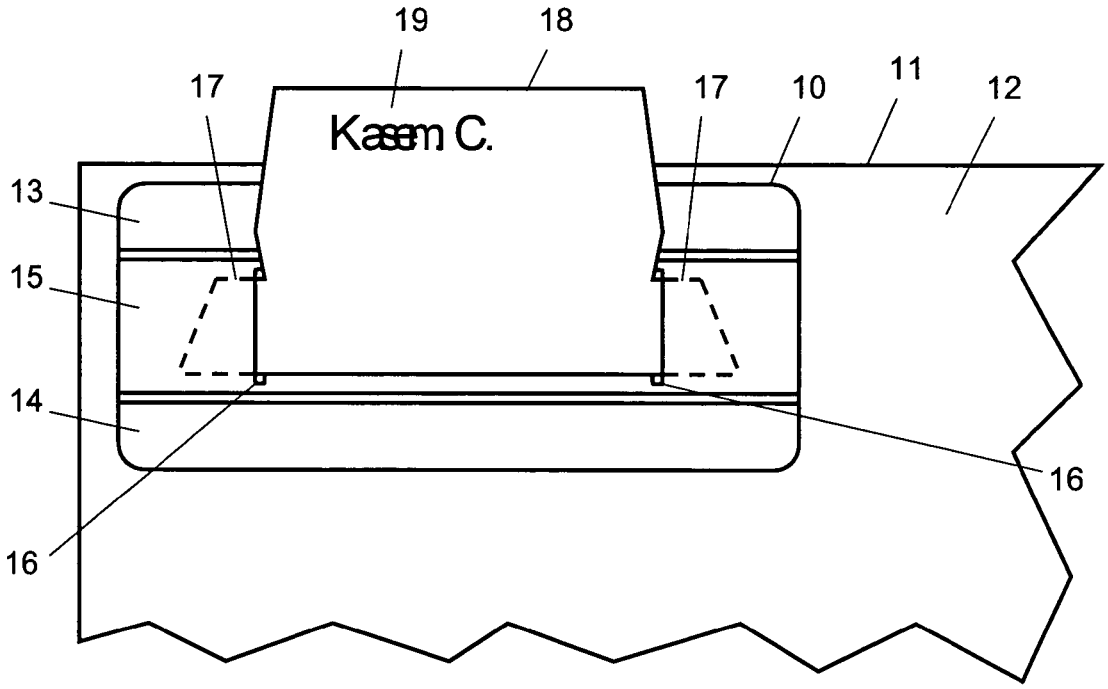
FIG. 1 illustrates an adapter attached to a file folder, with an engaged index tab, shown in a front view.
Figure 2:
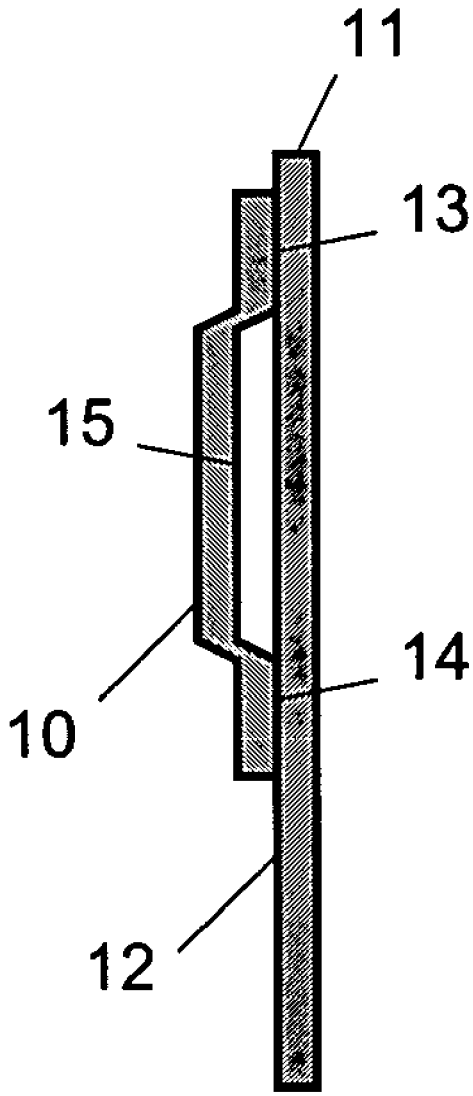
FIG. 2 illustrates a side view of an adapter attached to a file folder.

An embodiment of an index tab adapter is shown in FIGS. 1 and 2. The adapter 10 is attached roughly adjacent to an edge 11 of a file folder 12. File folder is defined at much more than a traditional two part folder, but can be any office requisite for which an index tab may be attached. A simple planar divider sheet (and it need not even be planar). It should preferably have an edge for the benefit of viewing the index tab, but again the tab may be used internally on an divider sheet, pocket folder, binder or the like. For purposes of this invention, the adapter may be applied to almost any office supply, even those not referred to as a folder, but for convenience, only, and not as limitation in the claims, they will all be called "folders". The folder 12 as drawn in FIG. 1 is exemplary, and any type of folder or file may be used, including hanging file folders, pocketed folders, and folders with slots, holes or notches that may accommodate index tabs of various types.

The adapter 10 is preferably made from an easily moldable plastic or card stock material, and may be transparent or may have a predetermined color scheme or design. The adapter 10 should be flexible, but structurally rigid enough to support a plastic index tab (indicator) 18 without tearing. The adapter 10 may have adhesive/adherent portions 13 and 14, preferably located on either side of a non-adhesive portion 15. In this instance "adherent" is meant to mean any form of attachment mechanism. It may be a chemical based adhesive, a mechanical or even magnetic adherent. So mechanical expedients, such as slotted fasteners, hook and loop fasteners, etc. are specifically denoted in this document but the scope of this invention is intended to cover others known in the art. The adhesive may be a pressure-sensitive adhesive, applied to the adhesive portions 13 and 14 at the factory, and shipped to the user with a detachable backing layer (not shown). The adhesives and backing layers are well-known in the art, and are commonly used for labels. Other adhesive means may also be employed, including removable/reusable products, such as Velcro® hook adhesive. After the backing layer is removed from each of the adhesive portions 13 and 14, the label may be affixed to a given file folder 12 adjacent to a particular edge 11. The location of the adapter 10 is determined by the user, who presumably chooses a location in accordance with a particular indexing scheme already in use.

The adhesive portions 13 and 14 are pressed into contact with the file folder 12 by the user, and preferably become non-removably attached thereto. The non-adhesive portion 15 (35 in other figures) is preferably spaced apart from the file folder 12 and may contain one or more slots 16. Portion 15/35 may also be elevated or raised relative to the side portions 13 and 15 to allow space for the tabs 17 to reside The slots 16 are shaped to engage a particular style of index tab, so that when a given index tab is inserted into the slots 16 in the adapter 10, the given index tab becomes attached to the file folder 12, and the file folder 12 may be identified by the given index tab as if it were originally configured to accept the style of the given index tab. Put another way, an index tab removably engages slots in the adapter, rather than slots in the file folder itself.

For example, if a file folder 12 is to be incorporated into a filing system that uses slot-in index tabs, and the file folder 12 is designed for a different style of index tabs or for no tabs at all, then an adapter 10 may be attached to the file folder 12, wherein the adapter 10 may receive slot-in index tabs. Once applied to the file folder 12, the adapter 10 then allows the file folder 12 to be identified by slot-in index tabs, and thereby be incorporated into the filing system without replacement of the file folder 12 itself.

An exemplary index tab 18 is shown in FIG. 1. The index tab 18 may have one or more engagement tabs 17 that engage the slots 16 in the adapter 10 and secure the index tab 18 to the adapter 10. The index tab 18 is drawn in FIG. 1 as a slot-in tab, but various other styles of attachable tabs may be used as well, including clip-on tabs. The index tab 18 may include an identifying portion 19 with identifying indicia, such as a name, an identification number, a color scheme, a bar code, or various other identification schemes that all generally well-known in the art. The adapter 10 may preferably accommodate readily available index tabs 18, similar in construction to those in common office use, although custom index tabs may also be used. The index tab 18 may be easily removed from the adapter 10, in the same manner in which a particular style of index tab may be easily removed from a file folder designed to accommodate that particular style of index tab.

FIG. 2 shows a side view of an adapter 10 attached roughly adjacent to an edge 11 of a file folder 12. The adapter 10 may have adhesive portions 13 and 14 and a non-adhesive portion 15. The non-adhesive portion 15 is preferably spaced apart from the file folder 12 in order to accommodate the engagement tabs of an index tab (not shown). Preferably, the adhesive portions 13 and 14 surround the non-adhesive portion 15 in order to provide adequate structural support for the adapter, although any suitable configuration for the adhesive may be used.

Figure 3:
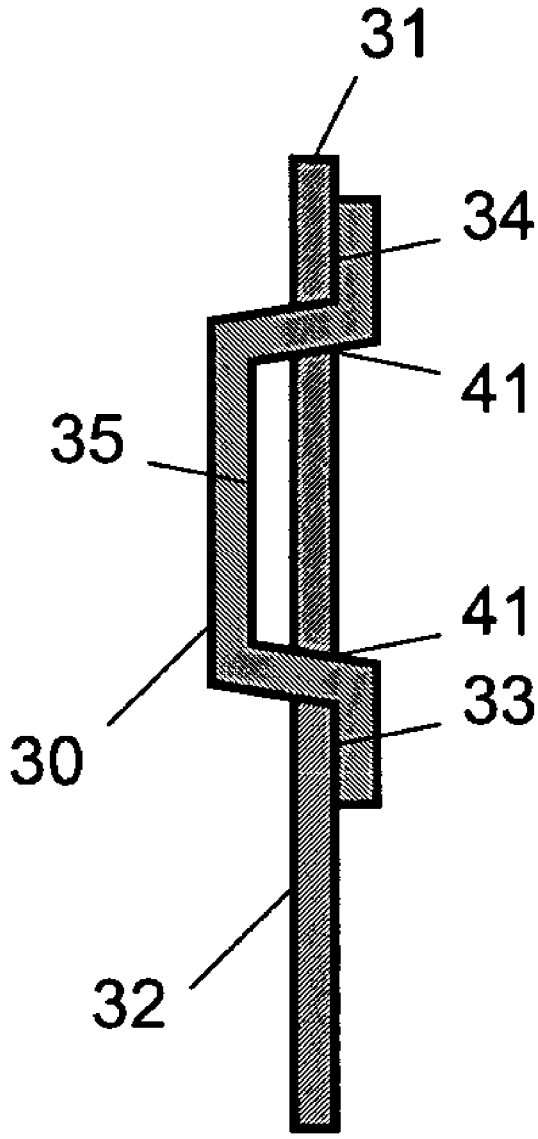
FIG. 3 illustrates a side view of an alternative embodiment of an adapter, attached to a file folder.
Figure 4:
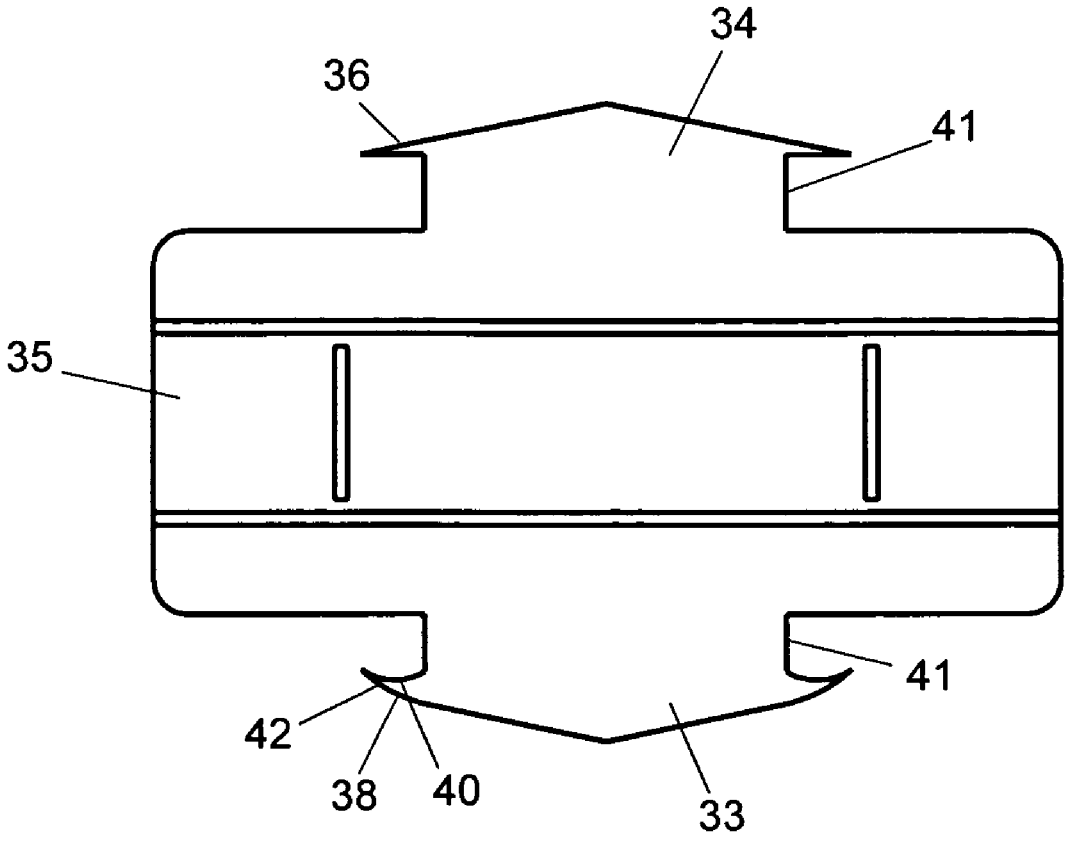
FIG. 4 illustrates a top view of an adapter with barbs.

In a further embodiment shown in FIG. 3, an adapter 30 is attached roughly adjacent to an edge 31 of a file folder 32. In contrast with the embodiment shown in FIGS. 1 and 2, where the adapter 10 is attached to the file folder 12 by adhesive, the adapter 30 of FIG. 3 may be attached to the file folder 32 by friction alone. The index tab portions 33 and 34, may be inserted through slots 41 to be cut in the file folder 32, and may be held in place by friction and the rigidity of the index tab 30. The portions 33 and 34 may be referred to as support tabs with upper and lower extensions.

In addition, to the mechanical attachment by fastener or expedients or hook and loop fasteners the index tab portions 33 and 34 may optionally have an adhesive that binds the adapter 30 to the file folder 32. In comparison with the embodiment of FIGS. 1 and 2, the embodiment of FIG. 3 has its adhesive applied on the opposite side of the adapter, and attaches to the opposite side of the file folder.

To assist in maintaining portions 33 and 34 in engagement with slot 41, lateral extensions 36 and 38 may be provided. These extensions shown as barbs 36 and 38 are merely points that project sufficiently to allow the extensions/projections to pass through the slots under deformation. The extensions may be of any shape although the preferred shape is a one way configuration herein called "barbs" which, under deformation, allow entry into the slot but not easy removal by mere withdrawal without further deformation greater than the deformation for insertion. Using barbs 38 with a concave region 40 of smaller radius than convex region 42, the barb is made more capable of flexing when forced under bias through the slot of dimension less than the cross-section from barb-to-barb.

I claim:

1. An index tab adapter for attachment of a slot-in index tab to a file folder, the index tab having a pair of projecting tabs spaced apart a predetermined distance and an indicator element therebetween for use with the file folder, said file folder having an edge, the adapter comprising a) An adapter member having front and back faces;

b) a pair of spaced apart slots, sized to receive said projecting tab;

and wherein said adapter member is affixed to said file folder by engagement of its projecting tabs with said slots and wherein said back face of the adapter may be applied to the folder proximate its edge so that said indicator element on said index tab is positioned to be visible from the edge of the folder and wherein the adapter member includes support tabs, and wherein the file folder contains slots, and wherein the adapter may be secured to the file folder by engaging the support tabs in the file folder slots.

2. The adapter of claim 1 wherein the adapter is attached to the file folder by a mechanical fastener between the folder and the adapter.

3. The adapter of claim 1 wherein the adapter is adhered to the file folder by an adhesive.

4. The adapter of claim 3 wherein the adhesive is a hook and loop fastener.

5. The adapter of claim 1 wherein the adapter is attached to the file folder by a mechanical engagement between folder and adapter.

6. The adapter of claim 1 wherein said adapter member includes a central portion and two side portions, said central portion being raised relative to said side portions to allow space between said central portion and said folder to receive support tabs.

7. An index tab adapter for attachment of a slot-in index tab to folder, the folder itself having spaced apart slots, the index tab having a pair of projecting engagement tabs spaced apart a predetermined distance and an indicator element therebetween for use with a file folder, said file folder having an edge, the adapter comprising a) An adapter member having front and back faces and upper and lower extensions each having ends, said extensions being adapted to pass, at least in part, through said folder slots;

b) a pair of spaced apart slots, sized to receive said projecting tabs; and wherein said projecting tabs are affixed to said adapter by engagement the extensions and the folders slots so that said indicator element on said index tab is positioned to be visible from the edge of the folder and wherein said extensions have ends lateral extensions proximate said ends to prevent withdraw of said extensions from said folder slots once inserted.

8. The adapter of claim 7 wherein said lateral extensions are one-way barbs.

* * * * *